US007866222B2

(12) United States Patent
Moore et al.

(10) Patent No.: US 7,866,222 B2
(45) Date of Patent: Jan. 11, 2011

(54) MOBILE VACUUM SAMPLING SYSTEM

(75) Inventors: Troy Moore, Lakewood, CO (US); R. Bret Rhinesmith, Sheridan, WY (US); Tim Culp, Fort Worth, TX (US); George R. Price, Buffalo, WY (US)

(73) Assignee: Bret R. Rhinesmith, Pine, CO (US)

( * ) Notice: Subject to any disclaimer, the term of this patent is extended or adjusted under 35 U.S.C. 154(b) by 560 days.

(21) Appl. No.: 12/024,871

(22) Filed: Feb. 1, 2008

(65) Prior Publication Data

US 2009/0193884 A1 Aug. 6, 2009

(51) Int. Cl.
*G01N 1/14* (2006.01)

(52) U.S. Cl. ..... 73/864.34; 73/19.02; 73/19.1; 73/19.12

(58) Field of Classification Search ..... 73/19.02, 73/19.1, 19.12, 863.23, 863.81, 863.83, 864.34
See application file for complete search history.

(56) References Cited

U.S. PATENT DOCUMENTS 3,069,898 A * 12/1962 Vesper ..... 73/23.42
3,720,092 A * 3/1973 Reinecke ..... 73/19.02
4,090,392 A * 5/1978 Smith et al. ..... 73/863.23
4,489,779 A 12/1984 Dickinson et al.
4,585,060 A 4/1986 Bernardin et al.
4,628,750 A 12/1986 Welker
4,786,472 A * 11/1988 McConnell et al. ..... 422/61
4,800,763 A * 1/1989 Hakkers et al. ..... 73/863
5,341,691 A 8/1994 Callis et al.
RE34,754 E 10/1994 Dickinson et al.
5,357,781 A 10/1994 Tikijian
5,437,201 A 8/1995 Krueger
6,837,121 B2 * 1/2005 Sternberger et al. ..... 73/864.71
7,100,461 B2 9/2006 Bradley et al.
2006/0000298 A1 * 1/2006 Thompson et al. ..... 73/863.81

* cited by examiner

*Primary Examiner*—Daniel S Larkin
(74) *Attorney, Agent, or Firm*—Antoinette M. Tease

(57) ABSTRACT

A mobile vacuum sampling system comprising: an inlet; a first filter; a gas sample vacuum pump; a solenoid valve; a sample tube; a pressure gauge; a first block valve; a second filter; a micro filter; a gasifier; a gas analyzer; and a computational, recording and/or analysis display device; wherein a natural gas stream enters the gas sample vacuum pump via the inlet and is compressed to between 3 and 5 psig; wherein the sample tube collects natural gas to be analyzed; wherein the gas analyzer is portable; wherein the gas analyzer analyzes gas samples from the sample tube; and wherein the entire system is contained within a truck or other mobile unit.

16 Claims, 2 Drawing Sheets

MOBILE VACUUM SAMPLING SYSTEM

BACKGROUND OF THE INVENTION

1. Field of the Invention

The present invention relates generally to the field of fluid sampling, and more specifically, to a mobile sampling system for taking samples from a natural gas well that is at low pressure (less than 5 psig) or under vacuum and analyzing those samples in the field.

2. Description of the Related Art

In most cases, after years of production, the amount of natural gas available for production from a given well will decrease. The rate and quantity of the decrease will vary from well to well, but for many wells, it eventually becomes necessary to lower the pressure (to less than 5 psig) or place the well under vacuum in order to cause the natural gas to flow out of the well. In order to lower the pressure or place the well under vacuum, compressors, pumps and/or blowers are added to the pipeline system downstream of the wellhead electronic flow meter. Typically, the well operator can take a sample from the natural gas stream and analyze it in the field as long as the stream is under enough positive pressure to drive the fluid through the sampling and analysis equipment, but when the stream is at low pressure (less than 5 psig) or under vacuum, there has historically been no way to take the sample and analyze it. The reason it is important to have contemporaneous chemical compositional analysis of a natural gas sample is because it affects both economics and safety, as explained more fully below.

In terms of economics, it is customary in the natural gas industry for producers of natural gas to be paid based on the BTU (British Thermal Unit) corrected volume of the natural gas stream. The BTU content of a natural gas stream is calculated based on chemical compositional analysis of a natural gas sample. For example, the relative amounts of nitrogen, oxygen, carbon dioxide, methane, ethane and propane components of a coal bed natural gas sample all affect its BTU content. Producers generally pay taxes and royalties based on the wellhead quantities of natural gas, and such taxes and royalties are based on the BTU corrected volume of the natural gas, also known as MMBTU (million BTUs). If the BTU content is over-estimated (for example, because it is not based on current data), the producer will overpay taxes and royalties. For this reason, it is highly desirable to ascertain the BTU content of the natural gas in the field so that the producer has real-time data for the natural gas that is produced at the wellhead.

As fields age, the concentration of non-combustible gases (nitrogen and carbon dioxide) in the natural gas generally increases, and toward the end of the production life of a coal bed natural gas well, the concentration of non-combustible gases in the natural gas emanating from the well usually spikes. As the concentration of non-combustible components increases, the concentration of hydrocarbon components (which typically include, but are not limited to, paraffins like methane, ethane and propane) decreases, thereby decreasing the BTU value. For each well, there is a point at which it no longer makes economic sense to produce from that well because of the increased non-combustible components and decreased hydrocarbon content of the natural gas. Having access to this information in the field allows operators to make timely decisions concerning the allocation of production resources.

Contemporaneous access to the results of chemical compositional analysis in the field is highly beneficial not only for economic reasons but also because it affects safety. Information about the chemical composition of the natural gas stream may let the operator know if there are leaks in the system that require immediate attention. For example, high levels of nitrogen in the sample might signify to the operator that there are leaks drawing air into the system. The presence of oxygen (presumably from the atmosphere) in the sample means there could be a risk of fire when the natural gas is compressed. If the operator becomes aware of increased nitrogen levels or the presence of oxygen in the system, he or she can take immediate steps to remedy the situation to prevent catastrophic loss or injury. Downstream pipelines that receive the produced natural gas may have compositional quality specifications that limit the amount of non-hydrocarbon gases (carbon dioxide, hydrogen sulfide, other sulfur species, and oxygen) allowed into their system to maintain the system integrity.

As noted above, mechanisms currently exist for taking natural gas samples and analyzing them in the field as long as the well is under enough positive pressure so that the natural natural will flow through the sampling and analysis equipment. Aside from the present invention, however, no mechanism exists for taking natural gas samples and analyzing them in the field when the well is at low pressure (less than 5 psig) or under vacuum. This creates problems for the well operators because they must extract a sample from the natural gas stream under vacuum conditions, deliver the sample to an offsite laboratory, and wait—usually several days and oftentimes up to two weeks—for the results of the chemical compositional analysis. This procedure lacks the immediate results that are obtainable when the chemical compositional analysis is conducted in the field. Furthermore, it is generally more cost-effective to analyze a sample in the field than to send it out to a laboratory since the lag time requires multiple visits to the well to input the updated chemical compositional analysis into the electronic flow computer, and if there was a problem with the initial sample, the process would have to be repeated until accurate data was obtained.

Accordingly, it is an object of the present invention to provide a natural gas sampling system that will allow samples to be taken and chemically analyzed to determine the composition of the fluid flowing from wells that are at low pressure (less than 5 psig) or under vacuum. It is a further object of the present invention to provide a means for such chemical compositional analysis to occur in the field. Yet another object of the present invention is to provide a low pressure and vacuum sampling system that is mobile and can be taken from field to field.

BRIEF SUMMARY OF THE INVENTION

The present invention is a mobile vacuum sampling system comprising: an inlet; a first filter; a gas sample vacuum pump; a solenoid valve; a sample tube; a pressure gauge; a first block valve; a second filter; a micro filter; a gasifier; a gas analyzer; and a computational, recording and/or analysis display device; wherein the first filter is a membrane filter situated between the inlet and the gas sample vacuum pump; wherein a natural gas stream enters the gas sample vacuum pump via the inlet and is compressed to between 3 and 5 psig; wherein the solenoid valve is situated directly adjacent to the gas sample vacuum pump; wherein the solenoid valve and gas sample vacuum pump are controlled by an electrical switch; wherein when the solenoid valve is only open when the gas sample vacuum pump is on and pumping gas through the system; wherein when the vacuum pump is turned off, the solenoid valve is closed and prevents natural gas from flowing back through the compressor; wherein the sample tube is located downstream of the solenoid valve; wherein the sample tube collects natural gas to be analyzed; wherein the pressure gauge is situated downstream of the sample tube and gauges the pressure in the sample tube; wherein the purpose of the first block valve is to allow pressure to build in the sample tube prior to analysis of a natural gas sample; wherein the system comprises a highest physical point; wherein the second filter is a membrane filter situated downstream of the sample tube and at the highest physical point in the system; wherein the micro filter is located downstream of the second filter and upstream of the gasifier; wherein the micro filter remove solid particles from the natural gas stream prior to the stream entering the gas analyzer; wherein the gasifier is situated downstream of the micro filter and ensures that any natural gas entering the gas analyzer is in gaseous phase; wherein the gas analyzer is situated downstream of the gasifier; wherein the gas analyzer is portable; wherein the gas analyzer analyzes gas samples from the sample tube; and wherein the entire system is contained within a truck or other mobile unit.

In a preferred embodiment, the invention further comprises a drain, wherein the drain is located directly underneath the first filter. Preferably, the gas sample vacuum pump is oil-free, explosion-proof and portable; the gas sample vacuum pump is manufactured of stainless steel or polytetrafluoroethylene; and the gas sample vacuum pump has a Class 1, Division 1 electrical rating. The vacuum pump preferably compresses 0.6 cubic feet of gas per minute, has the ability to overcome 26.9 inches of Hg on the inlet side of the pump, and is run on 120-volt or 220-volt AC power.

In a preferred embodiment, the present invention further comprises a flow meter, wherein the flow meter is located between the pressure gauge and the second filter. Preferably, the present invention further comprises a second block valve and first vent located between the first block valve and flow meter and a third block valve and second vent located directly underneath the second filter. The micro filter is preferably a 5-micron filter.

In a preferred embodiment, the present invention further comprises a micro needle valve and third vent, wherein the micro needle valve and third vent are located on the gasifier and are used to purge the system in between natural gas samples.

In an alternate embodiment, the present invention is a mobile vacuum sampling system comprising: an inlet; a first filter; a gas sample vacuum pump; a solenoid valve; a sample tube; a pressure gauge; a first block valve; a second filter; a micro filter; a gasifier; a gas analyzer; and a computational, recording and/or analysis display device; wherein the first filter is a membrane filter situated between the inlet and the gas sample vacuum pump; wherein a gas stream enters the gas sample vacuum pump via the inlet and is compressed to between 3 and 5 psig; wherein the solenoid valve is situated directly adjacent to the gas sample vacuum pump; wherein the solenoid valve and gas sample vacuum pump are controlled by an electrical switch; wherein when the solenoid valve is only open when the gas sample vacuum pump is on and pumping gas through the system; wherein when the vacuum pump is turned off, the solenoid valve is closed and prevents gas from flowing back through the compressor; wherein the sample tube is located downstream of the solenoid valve; wherein the sample tube collects gas to be analyzed; wherein the pressure gauge is situated downstream of the sample tube and gauges the pressure in the sample tube; wherein the purpose of the first block valve is to allow pressure to build in the sample tube prior to analysis of a gas sample; wherein the system comprises a highest physical point; wherein the second filter is a membrane filter situated downstream of the sample tube and at the highest physical point in the system; wherein the micro filter is located downstream of the second filter and upstream of the gasifier; wherein the micro filter remove solid particles from the gas stream prior to the stream entering the gas analyzer; wherein the gasifier is situated downstream of the micro filter and ensures that any gas entering the gas analyzer is in gaseous phase; wherein the gas analyzer is situated downstream of the gasifier; wherein the gas analyzer is portable; wherein the gas analyzer analyzes gas samples from the sample tube; and wherein the entire system is contained within a truck or other mobile unit.

In a preferred embodiment, the invention further comprises a drain, wherein the drain is located directly underneath the first filter. Preferably, the gas sample vacuum pump is oil-free, explosion-proof and portable; the gas sample vacuum pump is manufactured of stainless steel or polytetrafluoroethylene; and the gas sample vacuum pump has a Class 1, Division 1 electrical rating. The vacuum pump preferably compresses 0.6 cubic feet of gas per minute, has the ability to overcome 26.9 inches of Hg on the inlet side of the pump, and is run on 120-volt or 220-volt AC power.

In a preferred embodiment, the present invention further comprises a flow meter, wherein the flow meter is located between the pressure gauge and the second filter. Preferably, the present invention further comprises a second block valve and first vent located between the first block valve and flow meter and a third block valve and second vent located directly underneath the second filter. The micro filter is preferably a 5-micron filter.

In a preferred embodiment, the present invention further comprises a micro needle valve and third vent, wherein the micro needle valve and third vent are located on the gasifier and are used to purge the system in between gas samples.

REFERENCE NUMBERS

Figure 1:
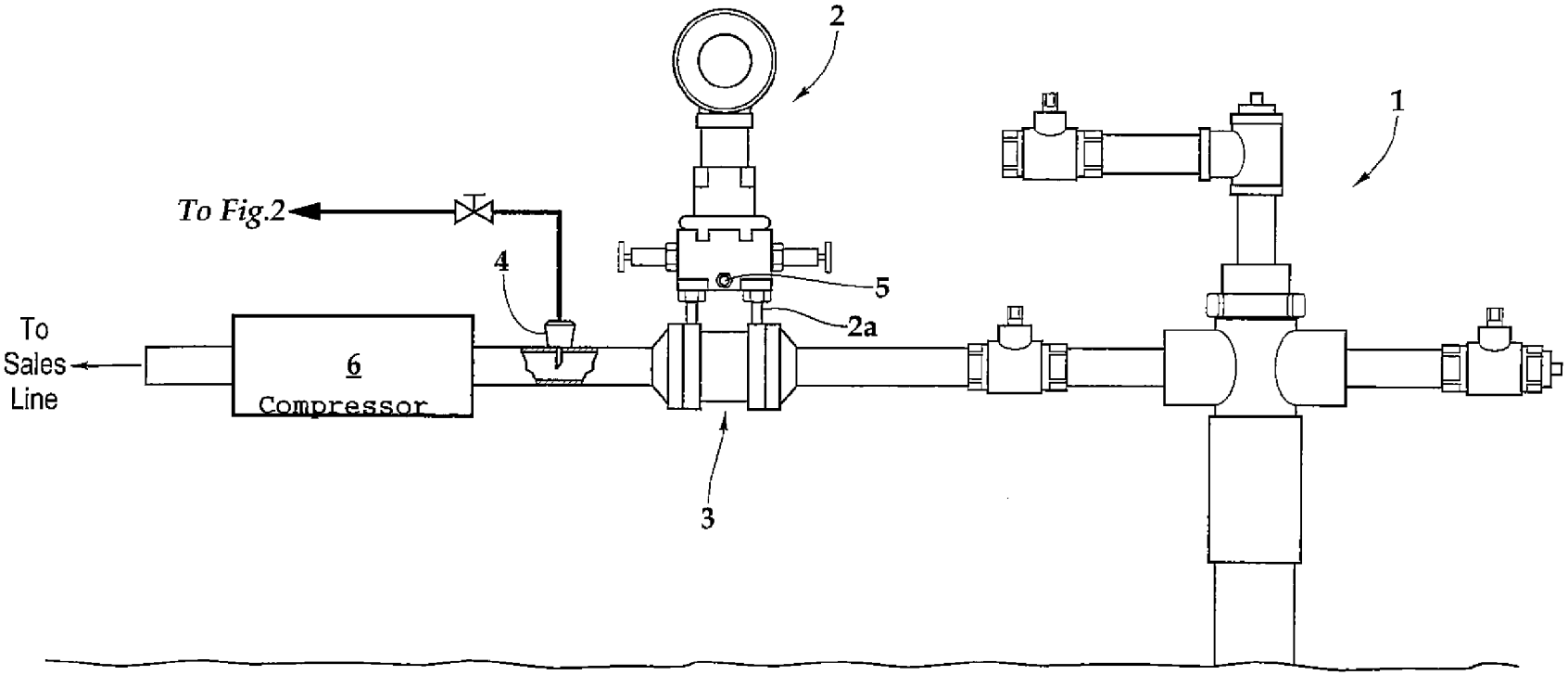
FIG. 1 is a diagram that shows the relation of the present invention to the wellhead.

1 Wellhead
2 Tertiary flow element (electronic flow computer)
2*a* Secondary flow element (sensing lines and transmitters)
3 Primary flow element (direct or inferential flow meter)
4 Stream sample probe
5 Manifold
6 Compressor/pump/blower
7 Truck/mobile unit
8 Inlet
9 First filter
10 Drain
11 Gas sample vacuum pump
12 Solenoid valve
13 Electrical switch
14 Sample tube
15 Pressure gauge
16 First block valve
17 Second block valve
18 First vent
19 Gas sample flow meter
20 Second filter
21 Third block valve

22 Second vent
23 Micro filter
24 Gasifier
25 Micro needle valve
26 Third vent
27 Gas analyzer
28 Computer

DETAILED DESCRIPTION OF INVENTION

The present invention is a system and method specifically designed for dealing with natural gas at low pressure (less than 5 psig) or under vacuum. The invention compresses the natural gas to sufficient levels to work in a sample system, such as a gas analyzer (for example, a gas chromatograph). As explained more fully below, the invention incorporates a number of filters to segregate liquids (including water) from the natural gas stream and also to prevent undesired particles from entering the gas analyzer.

FIG. 1 is a diagram that shows the relation of the present invention to the wellhead. In this figure, an electronic flow computer 2 is shown downstream of the wellhead 1. A primary flow element 3 is typically situated directly underneath the secondary flow element 2*a* and tertiary flow element (or electronic flow computer) 2. The manifold 5 is used to isolate the primary flow element 3 and the secondary flow element 2*a* when calibrating the measurement system. In the context of the present invention, the natural gas sample can be taken from a stream sample probe 4, which is typically located downstream of the electronic flow computer 2, or it can be taken directly from a vent on the manifold 5. The former method is preferable, but not all lines have a stream sample probe 4, in which case the sample could be taken directly from the electronic flow computer 2. The stream sample probe is not always installed or required, but it provides for a more representative sample if placed in the middle third of the pipe. The location of the sampling point is not critical to the operation of the present invention.

A compressor 6 (or, alternately, a pump or blower) is located downstream of the electronic flow computer 2 and stream sample probe 4. This compressor 6 reduces the wellhead pressure to enable higher production rates and higher recovery of oil and gas reserves. (Remember that the present invention is used in those cases where the oil and gas reservoir is so depleted that it will not economically flow unless the wellhead pressure is reduced to a low pressure (less than 5 psig) or placed under vacuum.) The sample that is taken from the stream sample probe 4 (or the vent in the manifold 5, whichever the case may be) is the sample that enters the present invention.

Figure 2:
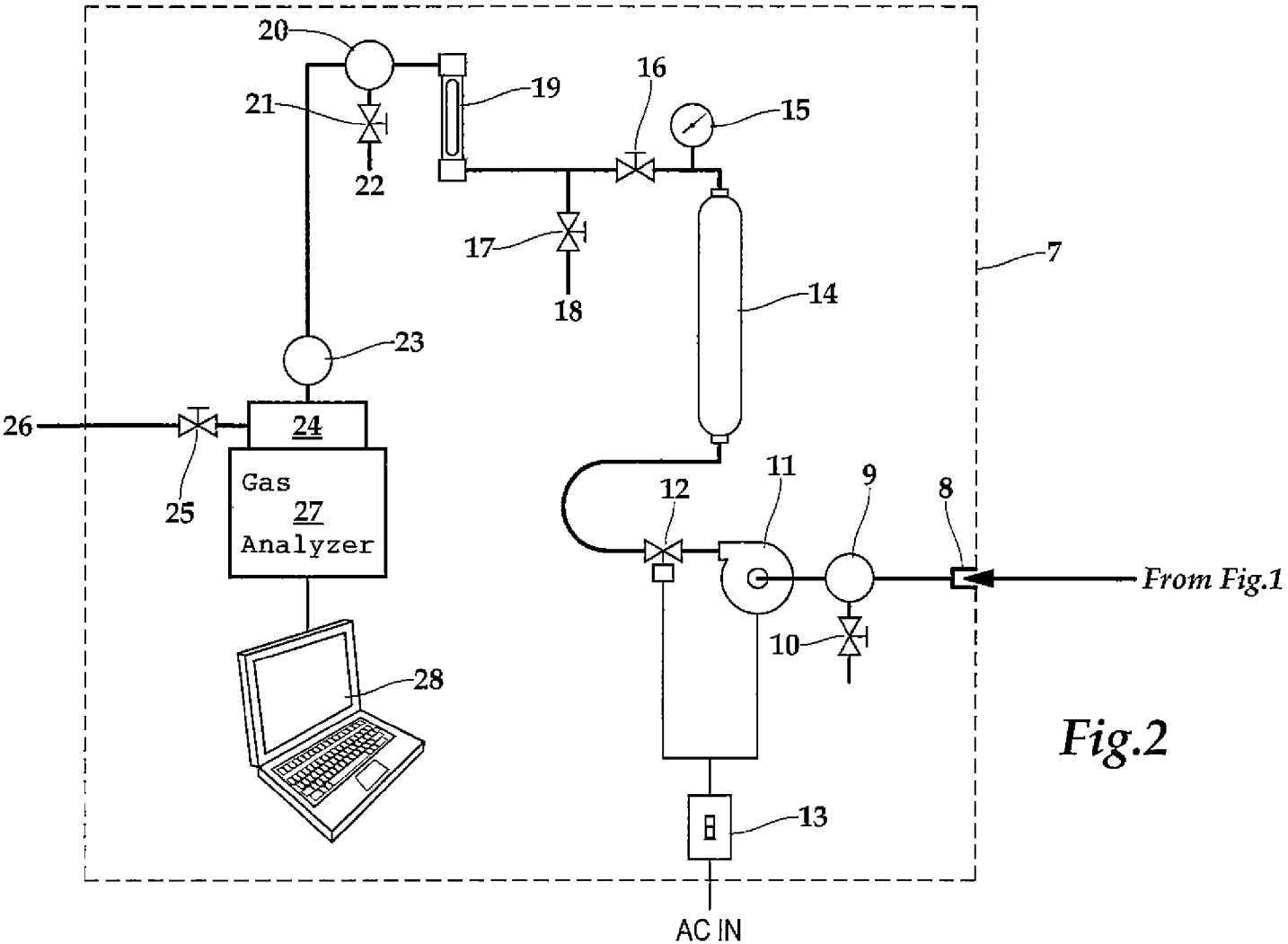
FIG. 2 is a schematic drawing that shows the various components of the present invention.

FIG. 2 is a schematic drawing that shows the various components of the present invention. In order to be mobile, the invention is preferably contained within a truck or other mobile unit 7 that can travel from well to well and from field to field and that has access to a supply of electrical power. The sample from the stream sample probe 4 (or from the vent in the manifold 5) enters the invention through an inlet 8. Immediately downstream of the inlet 8 is a first filter 9. In a preferred embodiment, the first filter 9 is a GENIE Supreme Model 120 filter manufactured by A+ Corporation, LLC of Gonzales, La. The first filter 9 is a membrane filter, and its primary purpose is to allow gas molecules to pass through the filter while preventing liquid molecules (such as water, amines, glycols, frac fluids, corrosion inhibitors, other production chemicals, lube oils, production fluids, etc.) from passing through the filter.

Directly underneath the first filter 9 is a drain 10. The purpose of the drain 10 is to allow liquid to be drained from the system after the system has been shut down. After passing through the inlet 8 and first filter 9, the sample enters a gas sample vacuum pump 11. In a preferred embodiment, the gas sample vacuum pump 11 is a model UN026STI (EX) vacuum pump manufactured by KNF Neuberger, Inc. of Trenton, N.J. Any oil-free, explosion-proof vacuum pump with a Class 1, Division 1, electrical rating may be used as long as it is manufactured from a material that can withstand contamination, such as stainless steel or polytetrafluoroethylene, and of a suitable size for use in this particular application (i.e., small enough to be portable).

When the natural gas sample enters the gas sample vacuum pump, it is at low pressure (less than 5 psig) or under vacuum. When it exits the gas sample vacuum pump, it is under positive pressure, typically between 3 and 5 pounds per square inch gauge (psig). In a preferred embodiment, the gas sample vacuum pump 11 is able to compress 0.6 cubic feet of gas per minute and can be run on 120-volt or 220-volt AC power. The preferred gas sample vacuum pump must have sufficient head, that is, the differential pressure of (i) the lower pressure or the vacuum suction that is experienced by the well and (ii) the required discharge pressure needed to force the gas through the sampling and analysis equipment. In a preferred embodiment, the gas sample vacuum pump is able to overcome 26.9 inches of Hg on the suction side and compress the gas to a maximum of 6 psig discharge pressure.

A solenoid valve 12 lies directly adjacent to the gas sample vacuum pump 11. Note that both the solenoid valve 12 and gas sample vacuum pump 11 are controlled by the same electrical switch 13. This is key to the design of the present invention because it prevents the natural gas from flowing back through the gas sample vacuum pump. In other words, the valve is only open when the gas sample vacuum pump is on and pumping gas through the system. When the pump is turned off, the valve is also closed, thereby preventing backflow through the gas sample vacuum pump (which would otherwise occur because the gas in the wellhead system is at low pressure (less than 5 psig) under vacuum on the inlet side of the compressor, pump or blower).

Next, the natural gas sample travels to a sample tube 14, where the natural gas to be analyzed is collected. A pressure gauge 15 immediately downstream of the sample tube 14 is used to gauge the pressure in the sample tube 14. A first block valve 16 is preferably located downstream of the pressure gauge 15. The purpose of this valve 16 is to allow the operator to build pressure/volume in the sample tube 14 during the final phase of the pump/purge cycle (discussed below). The first block valve 16 is closed and the pressure is allowed to build up in the sample tube 14 to between 3 and 5 psig, at which point the solenoid valve 12 is closed and the gas sample vacuum pump 11 is shut off. The first block valve 16 is then opened and a sample is analyzed by the gas analyzer (e.g., gas chromatography 27 and the computer 28. A second block valve 17 and first vent 18 are optionally located between the first block valve 16 and gas sample flow meter 19 in case it becomes necessary to vent the system at this point.

A gas sample flow meter 19 located downstream of the first block valve 16 tells the operator whether natural gas is flowing through the system. After the sample passes through the gas sample flow meter 19, it passes through a second filter 20. The second filter 20 is preferably the same kind of filter as the first filter 9. The invention incorporates a second filter because compression causes much of the water and potentially some hydrocarbon in the vapor phase to condense into liquid phase; therefore, the second filter 20 will separate the liquid phase that forms after the sample exits the gas sample vacuum pump 11 from the gas sample. The sample tube 14 provides gas volume storage for the gas analyzer, and it also acts as a catch point for any liquid that may be present in the sample after compression. The second filter 20 will stop the migration of any liquid that is able to travel past the sample tube 14. The second filter 20 is preferably positioned at the highest point in the system so that any liquid that may be in the system will have difficulty passing through the gas sample flow meter 19 to the second filter 20. A third block valve 21 and second vent 22 are preferably located directly underneath the second filter 20 so that the system can be purged with natural gas prior to the natural gas entering the gas analyzer, as explained more fully below.

After the second filter 20, the sample passes through a micro filter 23 before entering the gasifier 24. The micro filter 23 is preferably a CP736729 manufactured by Varian, Inc. of Palo Alto, Calif., although any suitable 5-micron filter may be used. The purpose of the micro filter 23 is to remove grit, dirt, dust and other solid particles from the stream prior to entering the gas analyzer. The invention intentionally incorporates redundant filters to ensure that the sample entering the gas analyzer is free of liquids and entirely in gaseous phase (i.e., does not contain any solids or liquids).

The gasifier 24 is preferably a CP740431 also manufactured by Varian, Inc. of Palo Alto, Calif., although any suitable gasifier may be used. The gasifier 24 maintains the sample at a constant temperature and pressure and ensures that the entirety of the sample entering the gas analyzer is in a gaseous phase. If there were any liquid in the system at this point, the gasifier 24 would vaporize it. (The inclusion of water in liquid phase in the sample would damage the gas analyzer if it were to enter the gas analyzer, which is the reason for the gasifier. However, it is preferable to eliminate liquid even in gaseous phase from the sample because if present in anything other than miniscule quantities, it will dilute the natural gas sample and skew the results of the chemical compositional analysis. The first filter 9, together with the gas sample vacuum pump 11 and second filter 20, are the primary mechanisms for removing liquid from the sample.) A micro needle valve 25 and third vent 26 from the gasifier allows the system to be purged in between samples. Once the sample enters the gas analyzer 27, the gas analyzer analyzes the sample and transmits the results to a computer 28.

In a preferred embodiment, the gas analyzer 27 is a Varian CP 4900 Micro manufactured by Varian, Inc. of Palo Alto, Calif. The gas analyzer must be small enough to be portable, which typically means it will use a fused silica capillary column for sample separation. Other gas analysis technologies may be used in connection with the present invention.

To operate the present invention, the drain 10 must be closed, and the first block valve 16 open. The second block valve 17 and first vent 18 should be closed. The third block valve 21 and second vent 22, as well as the micro needle valve 25 and third vent 26, should also be closed. Next, the third block valve 21 and second vent 22 are opened slightly and the switch 13 turned on. With the switch 13 turned on, the solenoid valve 12 opens, and the gas sample vacuum pump 11 pulls natural gas from the inlet 8 into the sample tube 14. The pressure gauge 15 is used to monitor the pressure in the sample tube 14, and the third block valve 21 can be opened or closed slightly to maintain the pressure at a more or less constant three (3) to five (5) psig. This is continued for several minutes to purge the system (between the inlet 8 and the second vent 22) of any non-representative sample components.

Next, the micro needle valve 25 and third vent 26 are opened, and the third block valve 21 and second vent 22 are closed. With the gas sample vacuum pump 11 still on, the system is being purged through the gasifier 24.

After several minutes, the switch 13 is shut off, and the natural gas is allowed to flow out to atmosphere through the third vent 26 until the pressure decreases to three (3) psig. The switch 13 is then turned back on, and the gas sample vacuum pump 11 draws more natural gas into the system. This on-and-off cycle is continued for anywhere from a few to several iterations, with the operator watching the pressure gauge 15 to make sure that the pressure stays roughly within the range of three (3) to five (5) psig. (The sample must be between three (3) and five (5) psig in order for it to flow through the gas analysis equipment. When the operator is satisfied that the system has been adequately purged, the micro needle valve 25 and third vent 26 are closed. The first block valve 16 is also closed, allowing the pressure in the sample tube 14 to build to 3 to 5 psig, at which point the gas sample vacuum pump 11 is turned off and the first block valve 16 opened.

At this stage, the sample tube 14 is holding sufficient volume for at least four samples to be analyzed in the gas analyzer. Approximately 200 nanoliters are needed for each gas analyzer sample. Preferably, the sample tube 14 holds approximately 0.5 liters. The operator utilizes the computer 28 to generate and display the gas analyzer results. Typically, four samples are analyzed and the first one disregarded. Once the samples have been analyzed, the third block valve 21 and second vent 22 are opened, and the natural gas is allowed to flow out to atmosphere. The stream sample probe 4 is shut off, or if the sample is being drawn from the vent in the manifold 5, the vent line is disconnected. Lastly, the drain 10 is opened to allow any liquid that was collected during the process to drain out of the system. The drain 10 is preferably located at a relatively low point in the system to allow the liquid to drain out more easily.

Although the above examples deal primarily with coal natural gas wells, the present invention can be used with any natural gas well that is at low pressure (less than 5 psig) or under vacuum or that is experiencing a pressure sufficiently low as to not allow for a representative sample to be taken from the production stream in a timely and efficient manner. In addition to production analysis (i.e., from the wellhead 1 to the compressor 6), the invention may be used in other parts of the oil and gas collection and condition systems including pipelines, compression, storage, separation, treating and processing (collectively, midstream operations), and delivery systems (downstream operations) in which the streams are at a low pressure (less than 5 psig) or vacuum condition where there is not enough pressure for the gas to flow through the sampling and analysis apparatus. Examples of where this invention may be used in midstream operations include compressor station suction, vapor recovery units, flare systems, flash gas systems, amine regeneration, tri-ethylene glycol regeneration, oil stock tank vents, fuel gas systems, blanket gas systems, etc.

Furthermore, the present invention may be used to gather sample data on any low-pressure system (not necessarily a well) where there is positive pressure, but the pressure is intermittent or too low for a conventional system to be used. For example, the present invention could be used to analyze samples from fluid storage tanks, where the hydrocarbon fluid naturally vaporizes or flashes to a gas phase due to temperature changes.

Although the preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A mobile vacuum sampling system comprising:

(a) an inlet;

(b) a first filter;

(c) a gas sample vacuum pump;

(d) a solenoid valve;

(e) a sample tube;

(f) a pressure gauge;

(g) a first block valve;

(h) a second filter;

(i) a micro filter;

(j) a gasifier;

(k) a gas analyzer; and (l) a computational, recording and/or analysis display device;

wherein the first filter is a membrane filter situated between the inlet and the gas sample vacuum pump;

wherein a natural gas stream enters the gas sample vacuum pump via the inlet and is compressed to between 3 and 5 psig;

wherein the solenoid valve is situated directly adjacent to the gas sample vacuum pump;

wherein the solenoid valve and gas sample vacuum pump are controlled by an electrical switch;

wherein when the solenoid valve is only open when the gas sample vacuum pump is on and pumping gas through the system;

wherein when the vacuum pump is turned off, the solenoid valve is closed and prevents natural gas from flowing back through the compressor;

wherein the sample tube is located downstream of the solenoid valve;

wherein the sample tube collects natural gas to be analyzed;

wherein the pressure gauge is situated downstream of the sample tube and gauges the pressure in the sample tube;

wherein the purpose of the first block valve is to allow pressure to build in the sample tube prior to analysis of a natural gas sample;

wherein the system comprises a highest physical point;

wherein the second filter is a membrane filter situated downstream of the sample tube and at the highest physical point in the system;

wherein the micro filter is located downstream of the second filter and upstream of the gasifier;

wherein the micro filter removes solid particles from the natural gas stream prior to the stream entering the gas analyzer;

wherein the gasifier is situated downstream of the micro filter and ensures that any natural gas entering the gas analyzer is in gaseous phase;

wherein the gas analyzer is situated downstream of the gasifier;

wherein the gas analyzer is portable;

wherein the gas analyzer analyzes gas samples from the sample tube; and wherein the entire system is contained within a truck or other mobile unit.

2. The mobile vacuum sampling system of claim 1, further comprising a drain, wherein the drain is located directly underneath the first filter.

3. The mobile vacuum sampling system of claim 1, wherein the gas sample vacuum pump is oil-free, explosion-proof and portable;

wherein the gas sample vacuum pump is manufactured of stainless steel or polytetrafluoroethylene; and wherein the gas sample vacuum pump has a Class 1, Division 1 electrical rating.

4. The mobile vacuum sampling system of claim 3, wherein the vacuum pump compresses 0.6 cubic feet of gas per minute;

wherein the gas sample vacuum pump has the ability to overcome 26.9 inches of Hg on the inlet side of the pump; and wherein the gas sample vacuum pump is run on 120-volt or 220-volt AC power.

5. The mobile vacuum sampling system of claim 1, further comprising a flow meter, wherein the flow meter is located between the pressure gauge and the second filter.

6. The mobile vacuum sampling system of claim 1, further comprising a second block valve and first vent located between the first block valve and a flow meter and a third block valve and second vent located directly underneath the second filter.

7. The mobile vacuum sampling system of claim 1, wherein the micro filter is a 5-micron filter.

8. The mobile vacuum sampling system of claim 1, further comprising a micro needle valve and third vent, wherein the micro needle valve and third vent are located on the gasifier and are used to purge the system in between natural gas samples.

9. A mobile vacuum sampling system comprising:

(a) an inlet;

(b) a first filter;

(c) a gas sample vacuum pump;

(d) a solenoid valve;

(e) a sample tube;

(f) a pressure gauge;

(g) a first block valve;

(h) a second filter;

(i) a micro filter;

(j) a gasifier;

(k) a gas analyzer; and (l) a computational, recording and/or analysis display device;

wherein the first filter is a membrane filter situated between the inlet and the gas sample vacuum pump;

wherein a gas stream enters the gas sample vacuum pump via the inlet and is compressed to between 3 and 5 psig;

wherein the solenoid valve is situated directly adjacent to the gas sample vacuum pump;

wherein the solenoid valve and gas sample vacuum pump are controlled by an electrical switch;

wherein when the solenoid valve is only open when the gas sample vacuum pump is on and pumping gas through the system;

wherein when the vacuum pump is turned off, the solenoid valve is closed and prevents gas from flowing back through the compressor;

wherein the sample tube is located downstream of the solenoid valve;

wherein the sample tube collects gas to be analyzed;

wherein the pressure gauge is situated downstream of the sample tube and gauges the pressure in the sample tube;

wherein the purpose of the first block valve is to allow pressure to build in the sample tube prior to analysis of a gas sample;

wherein the system comprises a highest physical point;

wherein the second filter is a membrane filter situated downstream of the sample tube and at the highest physical point in the system;

wherein the micro filter is located downstream of the second filter and upstream of the gasifier;

wherein the micro filter removes solid particles from the gas stream prior to the stream entering the gas analyzer;

wherein the gasifier is situated downstream of the micro filter and ensures that any gas entering the gas analyzer is in gaseous phase;

wherein the gas analyzer is situated downstream of the gasifier;

wherein the gas analyzer is portable;

wherein the gas analyzer analyzes gas samples from the sample tube; and wherein the entire system is contained within a truck or other mobile unit.

10. The mobile vacuum sampling system of claim 9, further comprising a drain, wherein the drain is located directly underneath the first filter.

11. The mobile vacuum sampling system of claim 9, wherein the gas sample vacuum pump is oil-free, explosion-proof and portable;

wherein the gas sample vacuum pump is manufactured of stainless steel or polytetrafluoroethylene; and wherein the gas sample vacuum pump has a Class 1, Division 1 electrical rating.

12. The mobile vacuum sampling system of claim 11, wherein the vacuum pump compresses 0.6 cubic feet of gas per minute;

wherein the gas sample vacuum pump has the ability to overcome 26.9 inches of Hg on the inlet side of the pump; and wherein the gas sample vacuum pump is run on 120-volt or 220-volt AC power.

13. The mobile vacuum sampling system of claim 9, further comprising a flow meter, wherein the flow meter is located between the pressure gauge and the second filter.

14. The mobile vacuum sampling system of claim 9, further comprising a second block valve and first vent located between the first block valve and a flow meter and a third block valve and second vent located directly underneath the second filter.

15. The mobile vacuum sampling system of claim 9, wherein the micro filter is a 5-micron filter.

16. The mobile vacuum sampling system of claim 9, further comprising a micro needle valve and third vent, wherein the micro needle valve and third vent are located on the gasifier and are used to purge the system in between gas samples.

* * * * *

UNITED STATES PATENT AND TRADEMARK OFFICE

CERTIFICATE OF CORRECTION

PATENT NO. : 7,866,222 B2
APPLICATION NO. : 12/024871
DATED : January 11, 2011
INVENTOR(S) : Troy Moore et al.

It is certified that error appears in the above-identified patent and that said Letters Patent is hereby corrected as shown below:

On the Title Page:
Item (73) The Assignee is listed as Bret R. Rhinesmith but should be R. Bret Rhinesmith Signed and Sealed this
Fifteenth Day of March, 2011

David J. Kappos

David J. Kappos
*Director of the United States Patent and Trademark Office*